US011285730B2

(12) United States Patent
Nakamura et al.

(10) Patent No.: US 11,285,730 B2
(45) Date of Patent: Mar. 29, 2022

(54) LIQUID EJECTION APPARATUS AND LIQUID FILLING METHOD IN LIQUID EJECTION APPARATUS

(71) Applicant: CANON KABUSHIKI KAISHA, Tokyo (JP)

(72) Inventors: Yohei Nakamura, Yokohama (JP); Kazuhiro Yamada, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/812,218

(22) Filed: Mar. 6, 2020

(65) Prior Publication Data

US 2020/0290363 A1 Sep. 17, 2020

(30) Foreign Application Priority Data

Mar. 15, 2019 (JP) ..... JP2019-048489

(51) Int. Cl.
*B41J 2/165* (2006.01)
*B41J 2/175* (2006.01)
*B41J 2/18* (2006.01)

(52) U.S. Cl.
CPC ..... *B41J 2/18* (2013.01); *B41J 2/16505* (2013.01); *B41J 2/17566* (2013.01); *B41J 2/17596* (2013.01); *B41J 2/16508* (2013.01); *B41J 2002/17579* (2013.01)

(58) Field of Classification Search
CPC ..... B41J 2/18; B41J 2/17596; B41J 2/17566; B41J 2/16505; B41J 2/16508; B41J 2002/17579
See application file for complete search history.

(56) References Cited

U.S. PATENT DOCUMENTS

| | | | | |
|---|---|---|---|---|
| 9,315,041 | B2 | 4/2016 | Moriguchi et al. | B41J 2/175 |
| 9,327,513 | B2 | 5/2016 | Moriguchi et al. | B41J 2/175 |
| 9,358,803 | B2 | 6/2016 | Moriguchi et al. | B05B 7/24 |
| 9,751,317 | B2 | 9/2017 | Nakamura et al. | B41J 2/18 |
| 9,914,308 | B2 | 3/2018 | Yamada et al. | B41J 2/18 |
| 9,925,791 | B2 | 3/2018 | Yamada | B41J 2/17563 |
| 9,975,340 | B2 | 5/2018 | Karita et al. | B41J 2/1408 |
| 9,981,464 | B2 | 5/2018 | Karita et al. | B41J 2/04535 |
| 10,005,287 | B2 | 6/2018 | Yamada et al. | B41J 2/17596 |
| 10,195,868 | B2 | 2/2019 | Yamada et al. | B41J 2/17596 |
| 10,471,711 | B2 | 11/2019 | Karita et al. | B41J 2/16526 |
| 10,792,930 | B2 * | 10/2020 | Yamada | B41J 2/165 |

(Continued)

FOREIGN PATENT DOCUMENTS

JP 2018-108741 7/2018

*Primary Examiner* — Geoffrey S Mruk
(74) *Attorney, Agent, or Firm* — Venable LLP

(57) ABSTRACT

A liquid ejection apparatus includes a plurality of liquid ejection units ejecting different types of liquids. Each liquid ejection unit includes an ejection orifice which ejects a liquid, first and second liquid tanks which store the liquid, and a liquid flow path which connects the first liquid tank and the second liquid tank to each other across the ejection orifice. The liquid ejection apparatus further includes a cap member which covers of the ejection orifices of the plurality of liquid ejection units and forms a space sealed between the ejection orifices of the plurality of liquid ejection units and the cap member, and a pressure control mechanism which simultaneously pressurizes the first and second liquid tanks.

18 Claims, 8 Drawing Sheets

(56) References Cited

U.S. PATENT DOCUMENTS

| | | | | |
|---|---|---|---|---|
| 2017/0197426 | A1 | 7/2017 | Nagai et al. | B41J 2/18 |
| 2019/0092036 | A1 | 3/2019 | Yamada et al. | B41J 2202/21 |
| 2019/0100024 | A1 | 4/2019 | Yamada et al. | B41J 2/14145 |

* cited by examiner

LIQUID EJECTION APPARATUS AND LIQUID FILLING METHOD IN LIQUID EJECTION APPARATUS

BACKGROUND OF THE INVENTION

Field of the Invention

The present disclosure relates to a liquid ejection apparatus and a liquid filling method in a liquid ejection apparatus, and more particularly, to a liquid ejection apparatus which performs recording while causing a liquid to flow between two tanks.

Description of the Related Art

An ink jet recording apparatus is known, which causes ink to flow in a liquid ejection head, in order to discharge bubbles in a flow path or prevent thickening of ink in the vicinity of an ejection orifice. In the circulation type ink jet recording apparatus, the ink circulates between the liquid ejection head and an ink container, and bubbles which may cause ejection failure of the liquid ejection head are collected in the ink container together with the ink. At the beginning of an initial use of the liquid ejection head, it is necessary to fill the ejection orifice and a liquid path with ink so that bubbles do not remain in the ejection orifice and the liquid path. Japanese Patent Application Laid-Open No. 2018-108741 discloses a method for filling an ejection orifice and a liquid path with ink. First, the ejection orifice is covered with a cap member, a common liquid chamber is filled with ink by a negative pressure, and thereafter, a pressure inside the cap member is reduced by a decompression pump connected to the cap member. Thereby, the ink is discharged to a space in the cap member. Thereafter, the cap member is open to the atmosphere, and thus, it is possible to prevent outflow of the ink from the ejection orifice in a state where the ejection orifice is filled with the ink.

SUMMARY OF THE INVENTION

A liquid ejection apparatus of the present disclosure includes a plurality of liquid ejection units ejecting different types of liquids. Each liquid ejection unit includes an ejection orifice which ejects a liquid, first and second liquid tanks which store the liquid, and a liquid flow path which connects the first liquid tank and the second liquid tank to each other across the ejection orifice. The liquid ejection apparatus further includes a cap member which covers of the ejection orifices of the plurality of liquid ejection units and forms a space sealed between the ejection orifices of the plurality of liquid ejection units and the cap member, and a pressure control mechanism which simultaneously pressurizes the first and second liquid tanks.

Further features of the present disclosure will become apparent from the following description of exemplary embodiments with reference to the attached drawings.

DESCRIPTION OF THE EMBODIMENTS

In a case of a liquid ejection head capable of ejecting a plurality of colors of ink, an ejection orifice which ejects ink having colors different from each other is covered with a single cap member. In a configuration described in Japanese Patent Application Laid-Open No. 2018-108741, when a space in a cap member is decompressed, a plurality of colors of ink which have flowed out of an ejection orifice is mixed in the cap member. Accordingly, in a circulation type liquid ejection head, there is a possibility that the mixed color ink mixed in the cap member flows backward from the ejection orifice to a liquid path when the atmosphere is released. An object of the present disclosure is to provide a liquid ejection apparatus capable of filling a liquid flow path with a liquid without causing mixing.

Hereinafter, some embodiments of the present disclosure will be described with reference to the drawings. Embodiment described below is an illustration of this invention and does not limit a scope of the present disclosure. The present embodiment is directed to a thermal ink jet printer which generates bubbles by a heating element and ejects ink. However, the present disclosure can also be applied to an inkjet printer which employs a piezo method and other ink eject methods. The present embodiment is directed to a so-called line type liquid ejection head having a length corresponding to a width of a recording medium. However, the present disclosure can also be applied to a so-called serial type liquid ejection head which performs recording while scanning a recording medium. The present disclosure can also be applied to a liquid ejection apparatus which ejects a liquid other than ink.

First Embodiment

Figure 1:
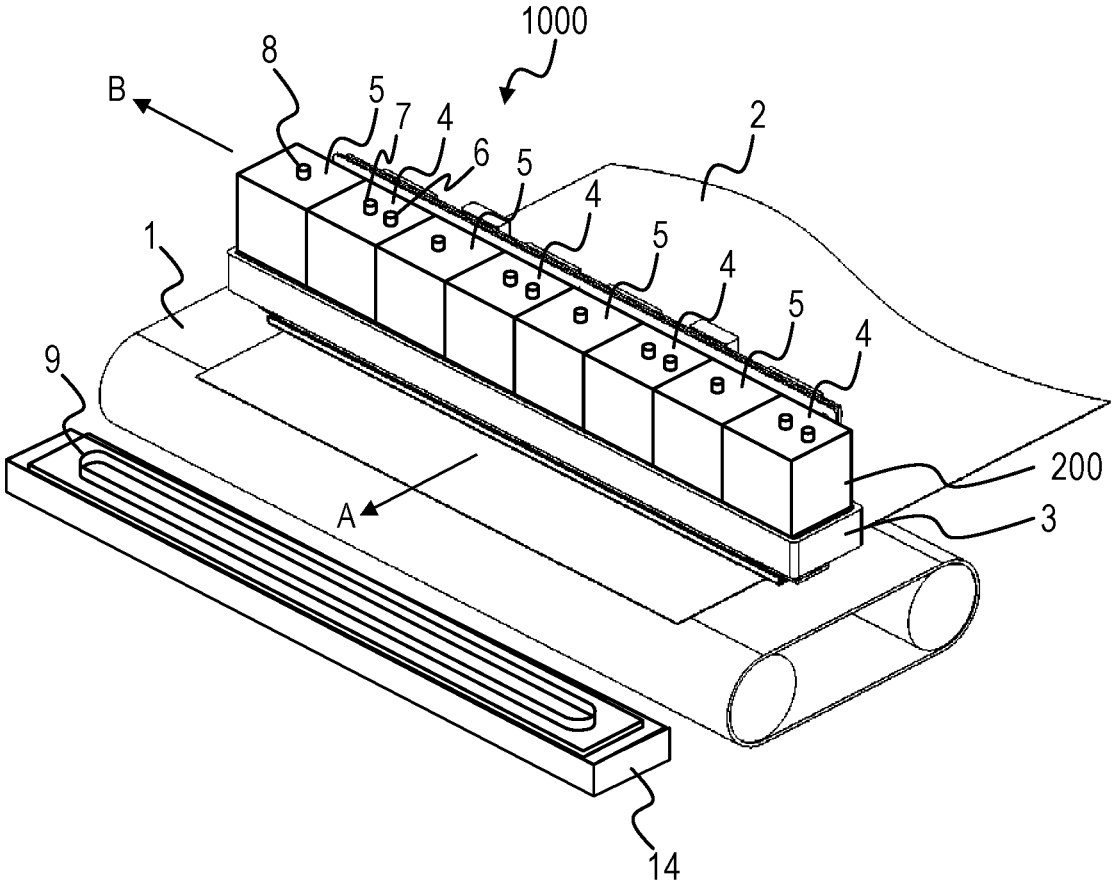
FIG. 1 is a schematic configuration view of a liquid ejection apparatus according to a first embodiment.

FIG. 1 illustrates a schematic configuration of an ink jet printer (hereinafter, referred to as a recording apparatus 1000) according to the present embodiment. The recording apparatus 1000 performs continuous recording in one pass while transporting the recording medium 2 continuously or intermittently. The recording medium 2 is not limited to cut paper but may be continuous roll paper. The recording apparatus 1000 can perform full color printing with CMYK (cyan, magenta, yellow, black) ink. The recording apparatus 1000 includes a transport unit 1 which transports a recording medium 2, a line type liquid ejection head 3 which extends in a direction B substantially orthogonal to a transport direction A of the recording medium 2, and first and second liquid tanks 4 and 5 which are mounted on the liquid ejection head 3 and store ink of each color. The first and second liquid tanks 4 and 5 are provided for each ink together with ejection orifices 13, an energy generating element 22, a liquid supply path 18, a liquid collection path 19, and a liquid flow path 21, which will be described later, and thus, constitute a liquid ejection unit 200 for each ink.

A cap member 9 is disposed at a position deviated from a transport path of the recording medium 2. When a recording operation is not performed, the cap member 9 is moved to a position, at which the cap member 9 covers the ejection orifices 13 of the liquid ejection head 3, by a cap member driving mechanism 14 which drives the cap member 9. Accordingly, the ejection orifices 13 are prevented from drying, and a suction operation for filling or recovering the ink can be performed. The cap member 9 covers the plurality of ejection orifices 13 of each liquid ejection unit 200 and forms a space sealed between the plurality of ejection orifices 13. The cap member 9 may include a check valve which is closed when a pressure in the space is a predetermined value or less and is opened when the pressure in the space exceeds a predetermined value.

Figure 2:
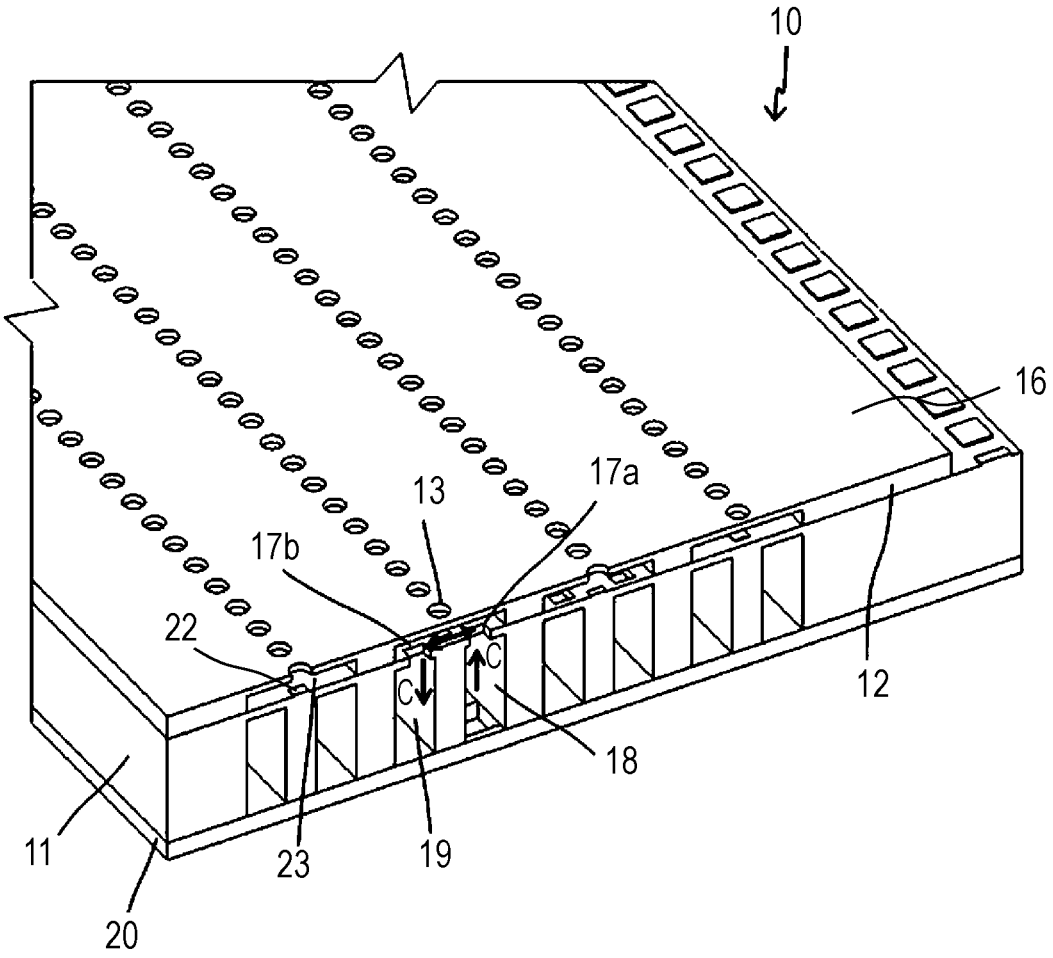
FIG. 2 is a schematic configuration view of a liquid ejection head and a liquid tank according to the first embodiment.

FIG. 2 is a perspective diagram illustrating the vicinity of the ejection orifices 13 of the liquid ejection head 3. The liquid ejection head 3 includes a substrate 11 which is made of S1, an ejection orifice forming member 12 which is made of a photosensitive resin and is stacked on the substrate 11, and a lid member 20 which is joined to a surface of the substrate 11 opposite to the ejection orifice forming member 12. The ejection orifice forming member 12 has an ejection orifice surface 16 on which the ejection orifices 13 through which the ink is ejected are formed. The energy generating element 22 which generates energy for ejecting the ink is formed on one surface of the substrate 11, and the liquid supply path 18 and the liquid collection path 19 extending along an ejection orifice row are formed on a side opposite to the one surface. A pressure chamber 23 including the energy generating element 22 is provided between the liquid supply path 18 and the liquid collection path 19, and the ejection orifices 13 through which the ink is ejected communicate with the pressure chamber 23. The liquid supply path 18 and the liquid collection path 19 constitute a portion of the liquid flow path 21 described later. One surface of each of the liquid supply path 18 and the liquid collection path 19 is formed by the lid member 20. Due to a pressure difference between the liquid supply path 18 and the liquid collection path 19, as illustrated by an arrow C, the ink flows from the liquid supply path 18 into the pressure chamber 23 via a supply port 17*a* and flows from a collection port 17*b* to the liquid collection path 19. According to the flow of the ink, in one of the ejection orifice 13 and the pressure chamber 23 from which the ink is not ejected, thickened ink generated by evaporation of water from the ejection orifice 13 is collected in the liquid collection path 19, and thus, it is possible to suppress thickening of the ink in one of the ejection orifice 13 and the pressure chamber 23. Moreover, bubbles or foreign substances existing in one of the ejection orifice 13 and the pressure chamber 23 are collected from the liquid collection path 19, and thus, it is possible to improve recording quality.

Figure 3:
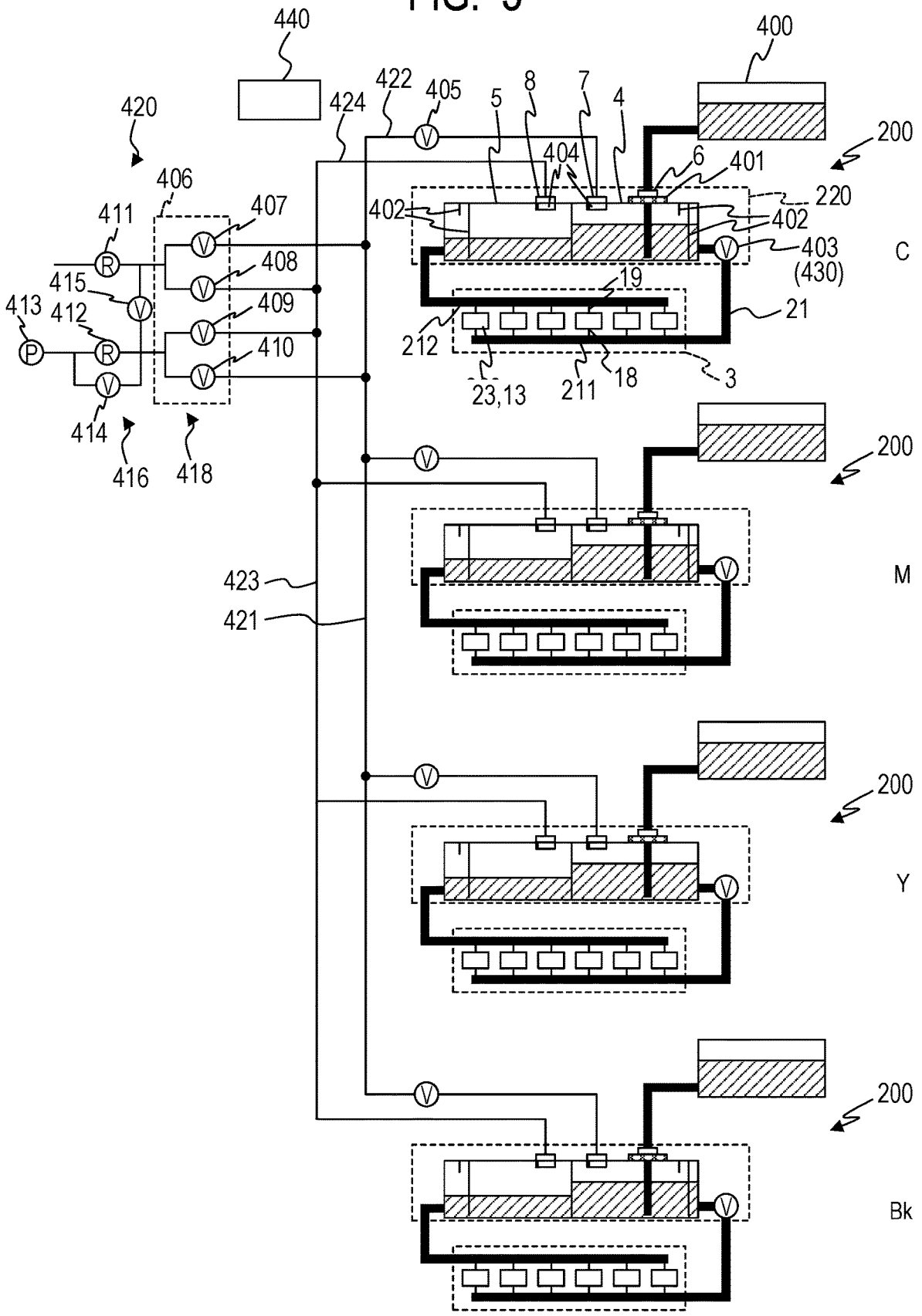
FIG. 3 is a perspective diagram illustrating a cross section of a recording element substrate.

FIG. 3 is a schematic diagram illustrating schematic configurations of the liquid ejection unit 200 and a pressure control mechanism in the present embodiment. In FIG. 3, the liquid ejection unit 200 of each color is illustrated individually. Here, the liquid ejection unit 200 of cyan (C) ink will be described as an example, but the liquid ejection units 200 of ink of other colors also have the same configuration. The liquid ejection unit 200 has a main tank 400 which communicates with the first liquid tank 4. The main tank 400 has a capacity larger than those of the first and second liquid tanks 4 and 5. The first liquid tank 4 and the main tank 400 are connected to each other by an ink joint 6. A filter 401 for preventing dusts from entering is disposed between the first liquid tank 4 and the main tank 400.

A liquid level gauge 402 which detects an amount of ink is provided inside each of the first liquid tank 4 and the second liquid tank 5. The first liquid tank 4 and the second liquid tank 5 include air connection ports 7 and 8 which allow inflow and outflow of air. Pressures in the first liquid tank 4 and the second liquid tank 5 are controlled by an air pressure supplied from a pressure control mechanism 420 described later via the air connection ports 7 and 8. Each of the air connection ports 7 and 8 includes a gas-liquid separation membrane 404 which prevents the ink from entering an air pipe. In order to prevent the first liquid tank 4 from becoming empty in a liquid filling step described later, the capacity of the second liquid tank 5 is smaller than the capacity of the first liquid tank 4.

The liquid ejection unit 200 has the liquid flow path 21 through which the ink flows between the first liquid tank 4 and the second liquid tank 5. The first and second liquid tanks 4 and 5 are connected to the ejection orifices 13 by the liquid flow path 21. The first liquid tank 4 and the second liquid tank 5 communicate with each other across the ejection orifices 13 by the liquid flow path 21, and the ink can flow between the first liquid tank 4 and the second liquid tank 5. One end of the liquid flow path 21 is connected to the first liquid tank 4 and the other end thereof is connected to the second liquid tank 5. The liquid flow path 21 includes a common supply flow path 211 which is connected to the first liquid tank 4, a common collection flow path 212 which is connected to the second liquid tank 5, the liquid supply path 18 which is connected to the common supply flow path 211, and the liquid collection path 19 which is connected to the common collection flow path 212. The ink in the first liquid tank 4 flows into the pressure chamber 23 through the common supply flow path 211 and the liquid supply path 18, and a portion of the ink is ejected from the ejection orifice 13 by driving the energy generating element 22. The remaining ink flows out from the pressure chamber 23, and is collected in the second liquid tank 5 through the liquid collection path 19 and the common collection flow path 212. In a case where the energy generating element 22 is not driven, the entire amount of ink which has flowed into the pressure chamber 23 flows out from the pressure chamber 23 and is collected in the second liquid tank 5 through the liquid collection path 19 and the common collection flow path 212.

The liquid ejection unit 200 further includes a flow path switching unit 430 which changes a configuration of the liquid flow path 21 and the pressure control mechanism 420 which applies a predetermined pressure to the first and second liquid tanks 4 and 5. Operations of the flow path switching unit 430 and the pressure control mechanism 420 are controlled by a controller 440 of the recording apparatus 1000. Hereinafter, configurations of the flow path switching unit 430 and the pressure control mechanism 420 will be described in detail.

The flow path switching unit 430 has a first valve 403 which is provided between the first liquid tank 4 and the ejection orifices 13. The first valve 403 is provided outside the liquid ejection head 3 in the common supply flow path 211. By closing the first valve 403, the first liquid tank 4 is isolated from the ejection orifices 13 and the second liquid tank 5, and the flow of the ink and pressure are shut off. This state is referred to as a first state. By opening the first valve 403, the first liquid tank 4 and the second liquid tank 5 communicate with each other across the ejection orifices 13. This state is referred to as a second state. Accordingly, the flow path switching unit 430 is operated so that the liquid flow path 21 can be switched between the first state and the second state. The first valve 403 is operated by the controller 440.

The pressure control mechanism 420 includes a first pressure generating unit 411 which generates a first pressure P1 and a second pressure generating unit 416 which generates a second pressure P2 which is a negative pressure lower than the first pressure P1. The first pressure generating unit 411 is a pressure reducing valve 411 of which one end side is opened to the atmosphere and the other end side is opened when a pressure is below a predetermined set pressure. Specifically, if the pressure of the first or second liquid tank 5 connected to the other end is lower than the set pressure, the valve 411 is opened, air flows into the first liquid tank or the second liquid tank 5, and the pressure of the first or second liquid tank 4 or 5 increases. Accordingly, the pressure in the first or second liquid tank 4 or 5 is maintained at the first pressure P1.

The second pressure generating unit 416 includes a vacuum pump 413, a negative pressure adjustment mechanism 412, and a bypass valve 414. The negative pressure adjustment mechanism 412 is connected to the vacuum pump 413 on an upstream side with respect to an air suction direction of the vacuum pump 413. The bypass valve 414 is disposed in parallel with the negative pressure adjustment mechanism 412. By opening the bypass valve 414, a strong negative pressure of the vacuum pump 413 bypasses the negative pressure adjustment mechanism 412 and can be directly applied to the first or second liquid tank 4 or 5. The negative pressure adjustment mechanism 412 is a back pressure valve 412 which is opened when the pressure of the connected first or second liquid tank 4 or 5 is higher than the set pressure. If the valve 412 is opened when the bypass valve 414 is closed, the vacuum pump 413 sucks the air in the first or second liquid tank 4 or 5 and reduces the pressure in the first or second liquid tank 4 or 5. Accordingly, the pressure in the first or second liquid tank 4 or 5 is maintained at the second pressure P2. The first pressure P1 and the second pressure P2 generate a driving force which causes the ink to flow. The first pressure P1 and the second pressure P2 are set so that the ink flows at a desired flow rate in the vicinity of the ejection orifice 13 and the ejection orifice 13 has an appropriate negative pressure. The first pressure P1 is generally set to atmospheric pressure, for example, about −50 mmAq. For example, the second pressure P2 is set to a negative pressure of about −250 mmAq. Accordingly, a differential pressure of about 200 mmAq can be obtained as a driving force of the ink, and the negative pressure of the ejection orifice 13 can be set to −150 mmAq.

The pressure control mechanism 420 includes a switching mechanism 418 between the first pressure generating unit 411 and the second pressure generating unit 416. The switching mechanism 418 has a differential valve 415 which is located between the first pressure generating unit 411 and the second pressure generating unit 416. By opening the differential valve 415, the pressure generated by the first or second pressure generating unit 411 or 416 can be simultaneously applied to the first liquid tank 4 and the second liquid tank 5. For example, when the valve 411 is opened in a state where the vacuum pump 413 is stopped, a pressure close to the atmospheric pressure is simultaneously applied to the first liquid tank 4 and the second liquid tank 5. As a result, the first and second liquid tanks 4 and 5 can be pressurized simultaneously. In addition, here, the pressurization means increasing a pressure (pressure increase, pressure boost), and it does not matter whether an absolute pressure after the pressurization is larger or smaller than atmospheric pressure. In the present embodiment, a large negative pressure reduced by the vacuum pump 413 is changed to a negative pressure (for example, a pressure of about =50 mmAq) close to the atmospheric pressure.

The pressure control mechanism 420 is provided in common for each type of ink. Specifically, a first common line 421 which is connected to the pressure control mechanism 420 and a first individual line 422 which branched off from the first common line 421 and is connected to each first liquid tank 4 are provided. In addition, a second common line 423 which is connected to the pressure control mechanism 420 and a second individual line 424 which is branched off from the second common line 423 and is connected to each second liquid tank 5 are provided. Each first individual line 422 is connected to the air connection port 7 of the first liquid tank 4 of each color, and each second individual line 424 is connected to the air connection port 8 of the second liquid tank 5 of each color. Moreover, an individual valve 405 is provided in each first individual line 422. The air connection port 7 of the first liquid tank 4 is connected to a switching unit 406 described later via the individual valve 405. Moreover, the air connection port 8 of the second liquid tank 5 is connected to the switching unit 406.

The switching mechanism 418 has the switching unit 406 including four valves 407 to 410. The valves 407 to 410 switch the connection between the first and second pressure generating units 411 and 416 and the air connection ports 7 and 8 of the first and second liquid tanks 4 and 5 to each other. In a case where the first liquid tank 4 is connected to the first pressure generating unit 411 and the second liquid tank 5 is connected to the second pressure generating unit 416, the controller 440 controls the valves 407, 408, 409, and 410 to open the valves 407 and 409 and close the valves 408 and 410. Since the pressure in the first liquid tank 4 is higher than the pressure in the second liquid tank 5, the ink circulates so that the ink is supplied from the first liquid tank 4 to the liquid ejection head 3 and the ink is collected in the second liquid tank 5. Conversely, by opening the valves 408 and 410 and closing the valves 407 and 409, the first liquid tank 4 is connected to the second pressure generating unit 416 and the second liquid tank 5 is connected to the first pressure generating unit 411. Since the pressure in the first liquid tank 4 is lower than the pressure in the second liquid tank 5, the ink reversely circulates so that the ink is supplied from the second liquid tank 5 to the liquid ejection head 3 and the ink is collected in the first liquid tank 5. The valve is switched based on a sequence such as filling and recovery of the ink described later, or a liquid level detected by the liquid level gauge 402 of the first and second liquid tanks 4 and 5. If a storage amount of any one of the liquid tanks exceeds a predetermined value, the valves are switched based on a signal from the liquid level gauge 402 of the liquid tank, and the circulation directions of all the color inks are switched simultaneously. Accordingly, bubbles accumulated in the liquid supply path 18 or the liquid collection path 19 can be efficiently discharged and it is possible to prevent non-ejection. In the present embodiment, the switching unit 406 includes four valves. However, the present disclosure is not limited to this configuration as long as the flow path can be switched. For example, two three-way valves may be provided, or one five-way valve may be provided. Further, instead of providing the differential valve 415 for opening to the atmosphere, the valves 407 and 408 may be opened and the valves 409 and 410 may be closed.

Figure 4:
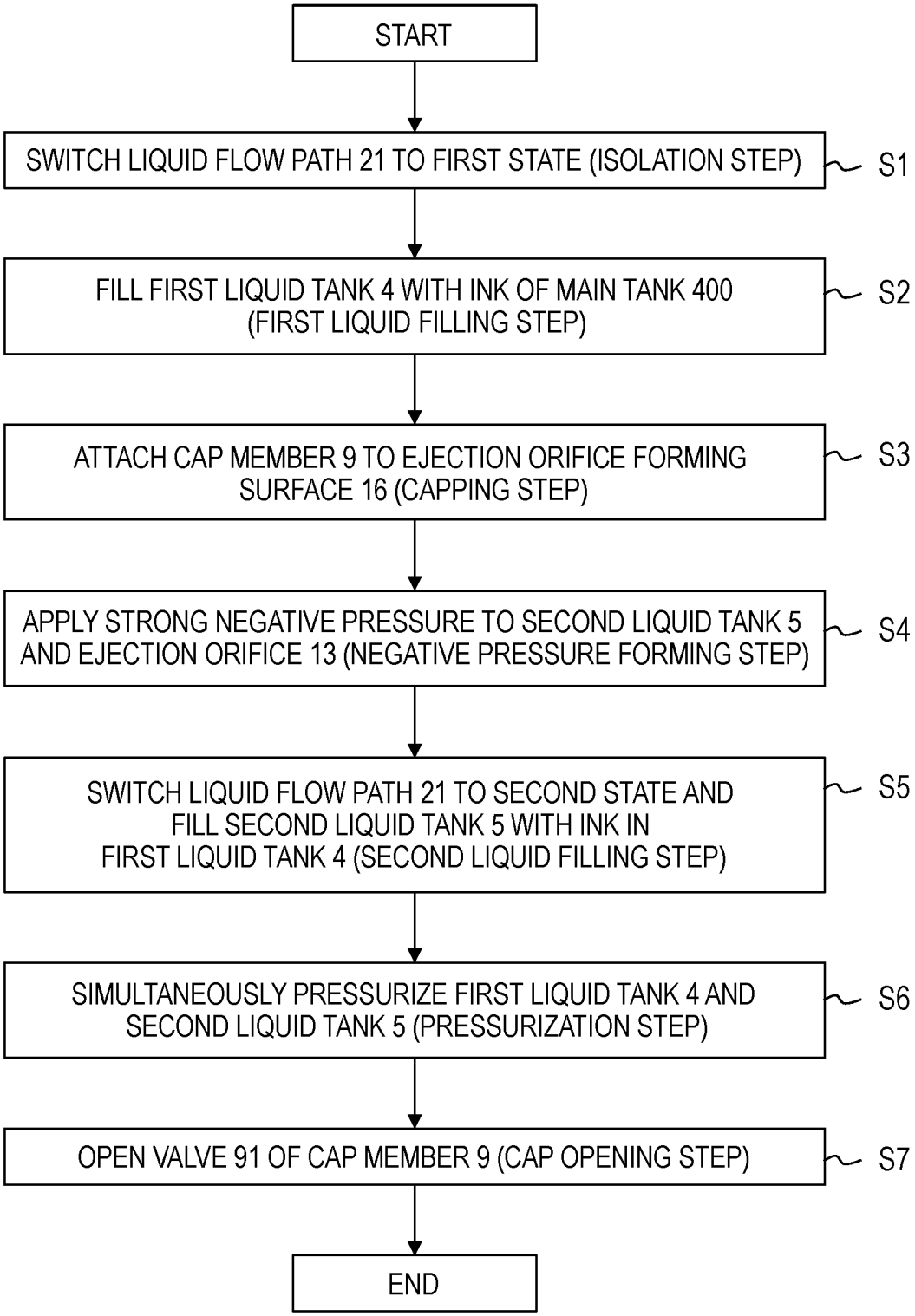
FIG. 4 is a schematic process diagram illustrating an ink filling method in a first embodiment.
Figure 5A:
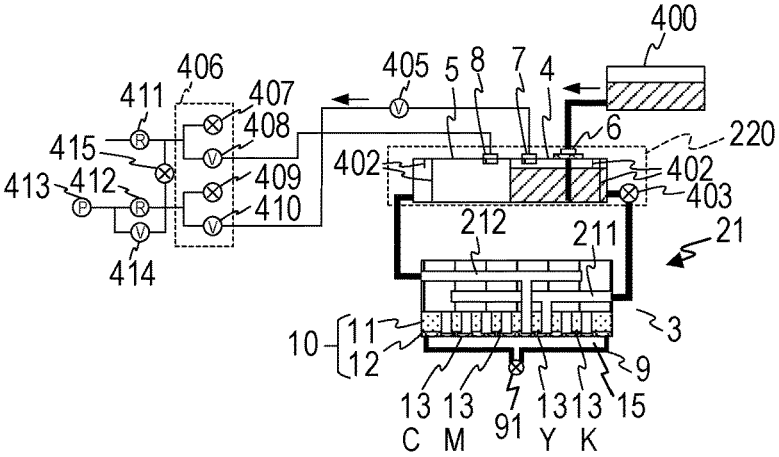
FIGS. 5A, 5B, 5C, 5D and 5E are schematic diagrams illustrating the ink filling method in the first embodiment.

Next, a method of filling the liquid ejection head 3 with ink will be described with reference to FIG. 4 and FIGS. 5A to 5E. FIG. 4 is a schematic process diagram illustrating an ink filling method, and FIGS. 5A to 5E are schematic diagrams illustrating the ink filling method. In FIGS. 5A to 5E, open valves V and a closed valves X are illustrated. First, as illustrated in FIG. 5A, the controller 440 closes the first valve 403 to switch the liquid flow path 21 to the first state (isolation step S1). Accordingly, the first liquid tank 4 is isolated from the ejection orifice 13 and the second liquid tank 5. Next, the controller 440 controls the switching unit 406 to open the valves 408 and 410 and close the valves 407 and 409. Further, the controller 440 opens the bypass valve 414 to drive the vacuum pump 413. The first liquid tank 4 is connected to the vacuum pump 413 without passing through the valve 412, and a strong negative pressure is applied to the first liquid tank 4. Accordingly, the first liquid tank 4 is filled with the ink in the main tank 400 (first liquid filling step S2). The controller 440 monitors a signal of the liquid level gauge 402 of the first liquid tank 4 for each color ink, and closes a corresponding individual valve 405 when the liquid level measured by the liquid level gauge 402 reaches a predetermined value. Since the individual valve 405 is controlled for each ink, even if there is a difference in ink viscosity or a difference in a remaining amount of ink in the first liquid tank 4, it is possible to reliably fill the first liquid tank 4 with all colors of ink to a maximum filling amount.

The controller 440 further controls the cap member driving mechanism 14 to attach the cap member 9 to the ejection orifice surface 16 (capping step S3). Moreover, the valve 91 connected to the cap member 9 is closed. Accordingly, the ejection orifices 13 of the plurality of liquid ejection units 200 are covered with the cap member 9, and a sealed space 15 is formed between the cap member 9 and the plurality of ejection orifices 13. Since the cap member 9 may be attached to the ejection orifice surface 16 before a negative pressure forming step S4 described below, the present step may be performed before the isolation step S1 or simultaneously with the isolation step S1.

Figure 5B:
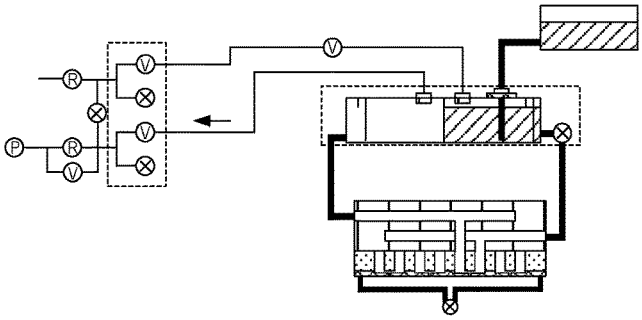

Next, as illustrated in FIG. 5B, the controller 440 opens the valves 407 and 409 and the bypass valve 414 and closes the valves 408 and 410 and the first valve 403. Accordingly, the first liquid tank 4 has a pressure (for example, −50 mmAq) controlled by the first pressure generating unit 411. The controller 440 operates the vacuum pump 413 in this state (negative pressure forming step S4). The second liquid tank 5, the ejection orifices 13, and a section of the liquid flow path 21 between the first valve 403 and the second liquid tank 5 communicate with the vacuum pump 413, and thus, the second liquid tank 5, the ejection orifices 13, and the section have strong negative pressure.

Figure 5C:
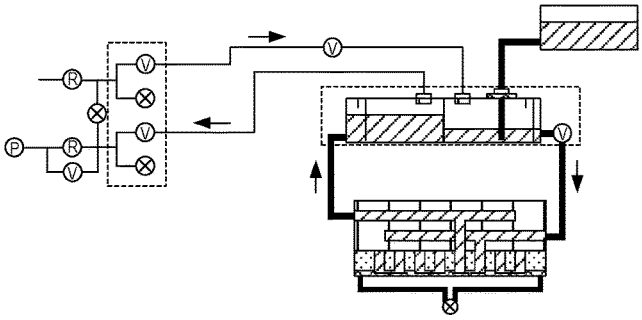

Next, as illustrated in FIG. 5C, the controller 440 opens the first valve 403. That is, after the first liquid filling step S2, the controller 440 controls the flow path switching unit 430 to bring the liquid flow path 21 into the second state. This step can be performed when the negative pressure sufficiently increases. A negative pressure lower than the pressure applied to the first liquid tank 4 is applied to the second liquid tank 5 by the pressure control mechanism 420. Due to this negative pressure, the ink in the first liquid tank 4 flows through the liquid flow path 21 via the first valve 403 and fills the second liquid tank 5 (second liquid filling step S5). Since the space 15 between the cap member 9 and the ejection orifice surface 16 is also at a negative pressure, the ejection orifice 13 is filled with the ink, and a part of the ink also flows into the space 15. Since the ink flows into the liquid flow path 21 at once after the liquid flow path 21 is evacuated, filling of ink having a small amount of bubbles can be performed. In addition, since the present step is simultaneously performed for each color ink, an ink filling time can be shortened. The liquid level of the second liquid tank 5 is monitored by the liquid level gauge 402 provided in each second liquid tank 5. Accordingly, when it is detected that any of the second liquid tanks 5 is filled up to the maximum filling amount, the controller 440 stops the vacuum pump 413.

Figure 5D:
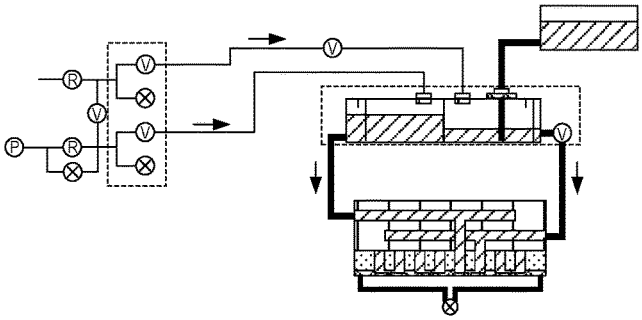

Next, as illustrated in FIG. 5D, the controller 440 closes the bypass valve 414 to open the differential valve 415. Accordingly, the first liquid tank 4 and the second liquid tank 5 are set to the pressure of the first pressure generating unit 411, and a strong negative pressure of the second liquid tank 5 is quickly eliminated. Inflow of the ink from the first liquid tank 4 to the second liquid tank 5 is stopped. The liquid flow path 21 in the vicinity of the ejection orifices 13 is pressurized from both the first liquid tank 4 and the second liquid tank 5 at the same time, and thus, a portion of the ink in the liquid flow path 21, specifically, a portion of the ink in the vicinity of the ejection orifices 13 is discharged from the ejection orifice 13 to the space 15 (pressurization step S6). Therefore, mixed color ink which may flow into the liquid flow path 21 from the space 15 is discharged, and the mixed color ink is prevented from circulating through the liquid flow path 21.

Figure 5E:
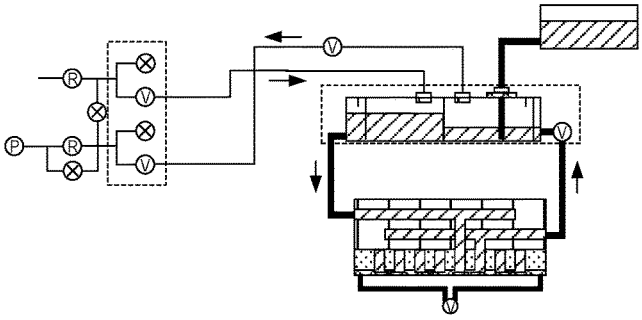

Finally, as illustrated in FIG. 5E, the valve 91 of the cap member 9 is opened (cap opening step S7). Accordingly, the ink is discharged from the space 15 in the cap, and the ejection orifices 13 are set to the atmospheric pressure, and an ink filling operation is completed. Thereafter, the differential valve 415 is closed, the valves 408 and 410 are opened, and the valves 407 and 409 are closed. Accordingly, circulation in a reverse direction from the second liquid tank 5 to which the first pressure P is applied to the first liquid tank 4 to which the second pressure P2 is applied starts.

Second Embodiment

Figure 6:
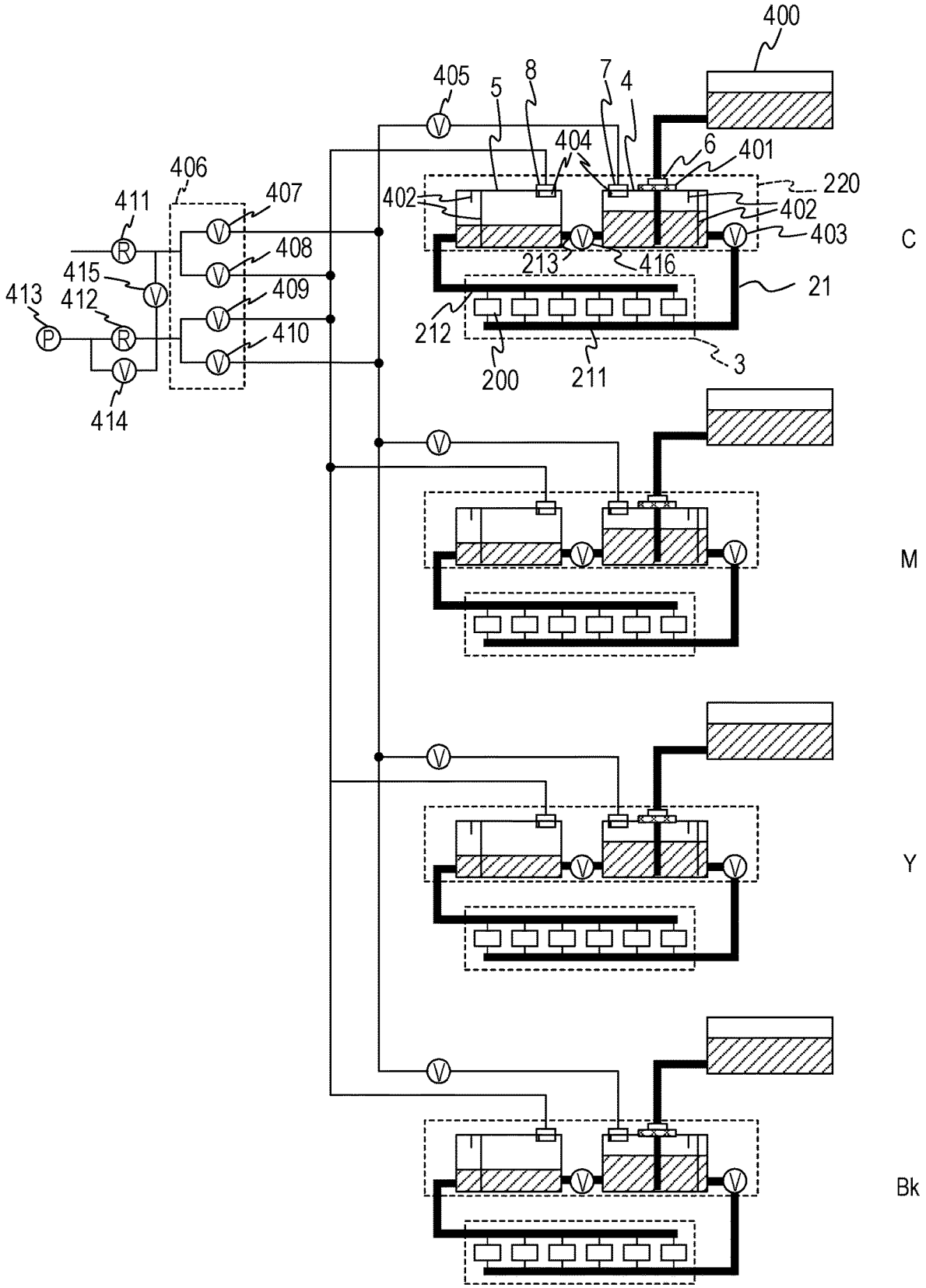
FIG. 6 is a schematic configuration view of a liquid ejection head and a liquid tank according to a second embodiment.

A second embodiment of the present disclosure will be described. Descriptions of the same configurations as those of the first embodiment is omitted, and differences from the first embodiment are mainly described. The present embodiment is the same as the first embodiment except that a second valve 416 is provided between the first liquid tank 4 and the second liquid tank 5 and a configuration of the pressure control mechanism 420 is different. FIG. 6 is a schematic diagram illustrating schematic configurations of the liquid ejection unit 200 and the pressure control mechanism 420 in the present embodiment. The liquid flow path 21 has a connection line 213 which connects the second liquid tank 5 to the first liquid tank 4. Accordingly, the liquid flow path 21 is a circulation flow path which connects the ejection orifices 13, the first liquid tank 4, and the second liquid tank 5 to each other. As in the first embodiment, the flow path switching unit 430 includes the first valve 403 provided between the first liquid tank 4 and the ejection orifices 13, and further includes the second valve 416 between the first liquid tank 4 and the second liquid tank 5. Accordingly, by closing the first valve 403 and the second valve 416, the liquid flow path 21 enters the first state. Meanwhile, by opening the first valve 403, the liquid flow path 21 enter the second state (opening and closing of the second valve 416 is irrelevant)

In the first embodiment, after the filling of the ink is performed from the main tank 400 to the first liquid tank 4 to the maximum filling amount, the ink in the first liquid tank 4 fills the second liquid tank 5. However, since an amount used varies depending on the type of ink, ink may remain in the second liquid tank 5 when filling into the second liquid tank 5 starts. In this case, the second liquid tank 5 may be filled up to the maximum filling amount immediately, and a lot of ink may remain in the first liquid tank 4. In other words, since a total amount of ink stored in the first liquid tank 4 and the second liquid tank 5 increases, the first liquid tank 4 and the second liquid tank 5 alternately reach the maximum filling amount in a short time during ink circulation, and a switching frequency of the ink circulation increases. That is, in the first embodiment, although the ink of all colors can circulate at once, the switching of the ink circulation frequently occurs in a case where there is a variation in the remaining amount of the ink. As a result, even when ink does not need the switching of the ink circulation, it is necessary to switch the circulation of the ink.

In the present embodiment, a second valve (communication valve) 416 is provided between the first liquid tank 4 and the second liquid tank 5. Accordingly, it is possible to replenish the second liquid tank 5 with the ink after the ink in the second liquid tank 5 is returned to the first liquid tank 4 once. Specifically, before the first liquid tank 4 is filled with the ink, the valves 408 and 410 are opened and the valves 407 and 409 are closed in a state where the ink circulates between the first liquid tank 4 and the second liquid tank 5. In addition, the valve 403 is closed and the second valve 416 is opened. Accordingly, the first liquid tank 4 has a pressure (for example, −250 mmAq) controlled by the second pressure generating unit 416, and the second liquid tank 5 has a pressure (for example, −50 mmAq) controlled by the first pressure generating unit 411. The ink can be returned from the second liquid tank 5 to the first liquid tank 4 via the second valve 416 due to a negative pressure generated between the first liquid tank 4 and the second liquid tank 5. Thereafter, the first liquid tank 4 is filled with ink. Therefore, in the present embodiment, when the first liquid tank 4 is filled up to the maximum filling amount, the second liquid tank 5 of each color is empty. As a result, the switching frequency of the ink circulation can be maximized. As described in the first embodiment, the replenishment of the ink from the main tank 400 to the first liquid tank 4 can be controlled individually for each color by the liquid level gauge 402 and the individual valve 405. Therefore, even if the ink is returned from the second liquid tank 5 to the first liquid tank 4, the first liquid tank 4 can be filled with the ink up to the maximum filling amount.

Figure 7A:
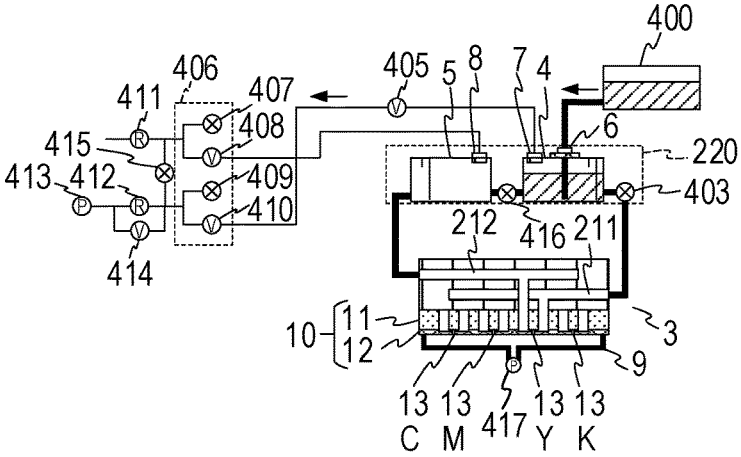
FIGS. 7A, 7B, 7C, 7D and 7E are schematic diagrams illustrating an ink filling method in the second embodiment.

Next, a method for filling the liquid ejection head 3 with ink will be described with reference to FIGS. 7A to 7E. First, as illustrated in FIG. 7A, the controller 440 closes the first valve 403 and the second valve 416 to switch the liquid flow path 21 to the first state (isolation step S1). Accordingly, the first liquid tank 4 is isolated from the ejection orifice 13 and the second liquid tank 5. Next, as in the first embodiment, the controller 440 controls the switching unit 406 to open the valves 408 and 410 and close the valves 407 and 409. Further, the controller 440 opens the bypass valve 414 to drive the first vacuum pump 413. Accordingly, the first liquid tank 4 is filled with the ink in the main tank 400 (first liquid filling step S2).

The controller 440 further operates the cap member driving mechanism 14 to attach the cap member 9 to the ejection orifice surface 16 (capping step S3). Accordingly, the ejection orifices 13 of the plurality of liquid ejection units 200 are covered with the cap member 9, and a sealed space 15 is formed between the cap member 9 and the plurality of ejection orifices 13. A second vacuum pump 417 is connected to the cap member 9. Since the cap member 9 may be attached to the ejection orifice surface 16 before the negative pressure forming step S4 described below, the present step may be performed before the isolation step S1 or simultaneously with the isolation step S1.

Figure 7B:
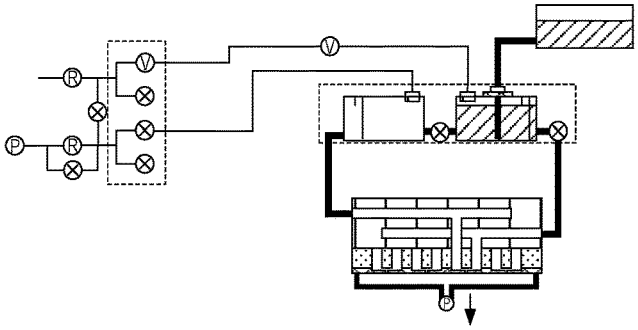

Next, as illustrated in FIG. 7B, the controller 440 opens the valve 407 and closes the valves 408 to 410. The first and second valves 403, 416 remain closed. Accordingly, the first liquid tank 4 has a pressure (for example, −50 mmAq) controlled by the first pressure generating unit 411. The controller 440 operates the second vacuum pump 417 in this state (negative pressure forming step S4). The second liquid tank 5, the ejection orifices 13, and a section of the liquid flow path 21 between the first valve 403 and the second liquid tank 5 communicate with the second vacuum pump 417, and thus, the second liquid tank 5, the ejection orifices 13, and the section have a strong negative pressure. As in the first embodiment, this step may be performed using the first vacuum pump 413. In the negative pressure forming step S4, the first valve 403 may be temporarily opened to supply ink to the common supply flow path 211, and then the first valve 403 may be closed. Accordingly, the amount of mixed color ink flowing into the common supply flow path 211 in the next step can be minimized. For example, a time during which the first valve 403 is open can be managed by a timer.

Figure 7C:
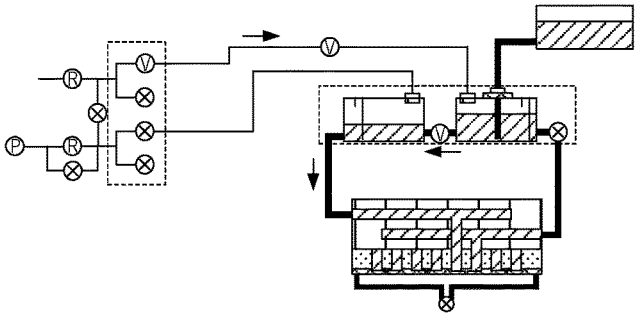

Next, as illustrated in FIG. 7C, the controller 440 opens the second valve 416. The ink flows from the first liquid tank 4 into the second liquid tank 5, and further flows through the liquid flow path 21. Since the second vacuum pump 417 is operated, the ink also flows from the ejection orifices 13 into the cap member 9. A section of the liquid flow path 21 between the ejection orifices 13 and the first valve 403 is filled with the ink. There is a high possibility that a plurality of color ink is mixed with each other in the inner space 15 of the cap member 9. If it is detected that a time sufficient for the flow path to be filled with the ink has elapsed or that any of the second liquid tanks 5 has been filled with the ink to the maximum filling amount, the controller 440 stops the second vacuum pump 417.

Figure 7D:
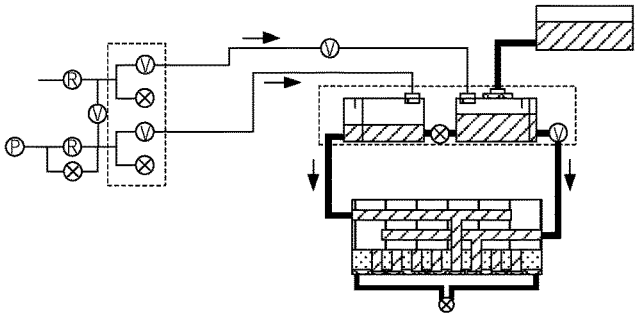
Figure 7E:
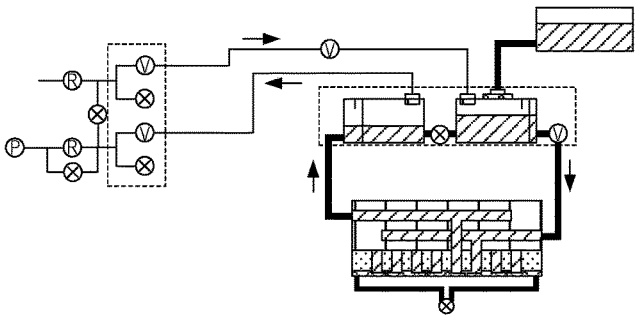

Next, as illustrated in FIG. 7D, the controller 440 opens the valves 407 and 409, closes the valves 408 and 410, and opens the differential valve 415. Accordingly, the first liquid tank 4 and the second liquid tank 5 are set to the pressure of the first pressure generating unit 411, and a strong negative pressure of the second liquid tank 5 is quickly eliminated. Moreover, the controller 440 opens the first valve 403 to switch the liquid flow path 21 to the first state. An ink flow from the first liquid tank 4 to the cap member 9 through the first valve 403 is generated, and the ink in the space 15 is discharged. Accordingly, the mixed color ink in the space 15 is prevented from flowing back through the liquid flow path 21. Thereafter, a preliminary ejection operation is performed and the ink is discharged. As a result, the mixed color ink that may have remained in the ejection orifices 13 in the vicinity of is discharged. As described above, in the present embodiment, the mixed color ink which may flow into the liquid flow path 21 is discharged by the pressurization of the first and second liquid tanks 4 and 5 and the preliminary ejection. Thereafter, as illustrated in FIG. 7E, the valves 407 and 409 are opened, and the valves 408 and 410 are closed. Accordingly, circulation in a reverse direction from the first liquid tank 4 to which the first pressure P is applied to the second liquid tank 5 to which the second pressure P2 is applied is started.

As described above, since the filling of the ink is performed from the first liquid tank 4 through the second liquid tank 5 using the second valve 416, a possibility that mixed color ink flows into the second liquid tank 5 side is reduced.

In addition, since the filling is performed in a state where the first valve 403 closed, a possibility that the mixed color ink is diffused to the first liquid tank 4 is also reduced.

Third Embodiment

Figure 8:
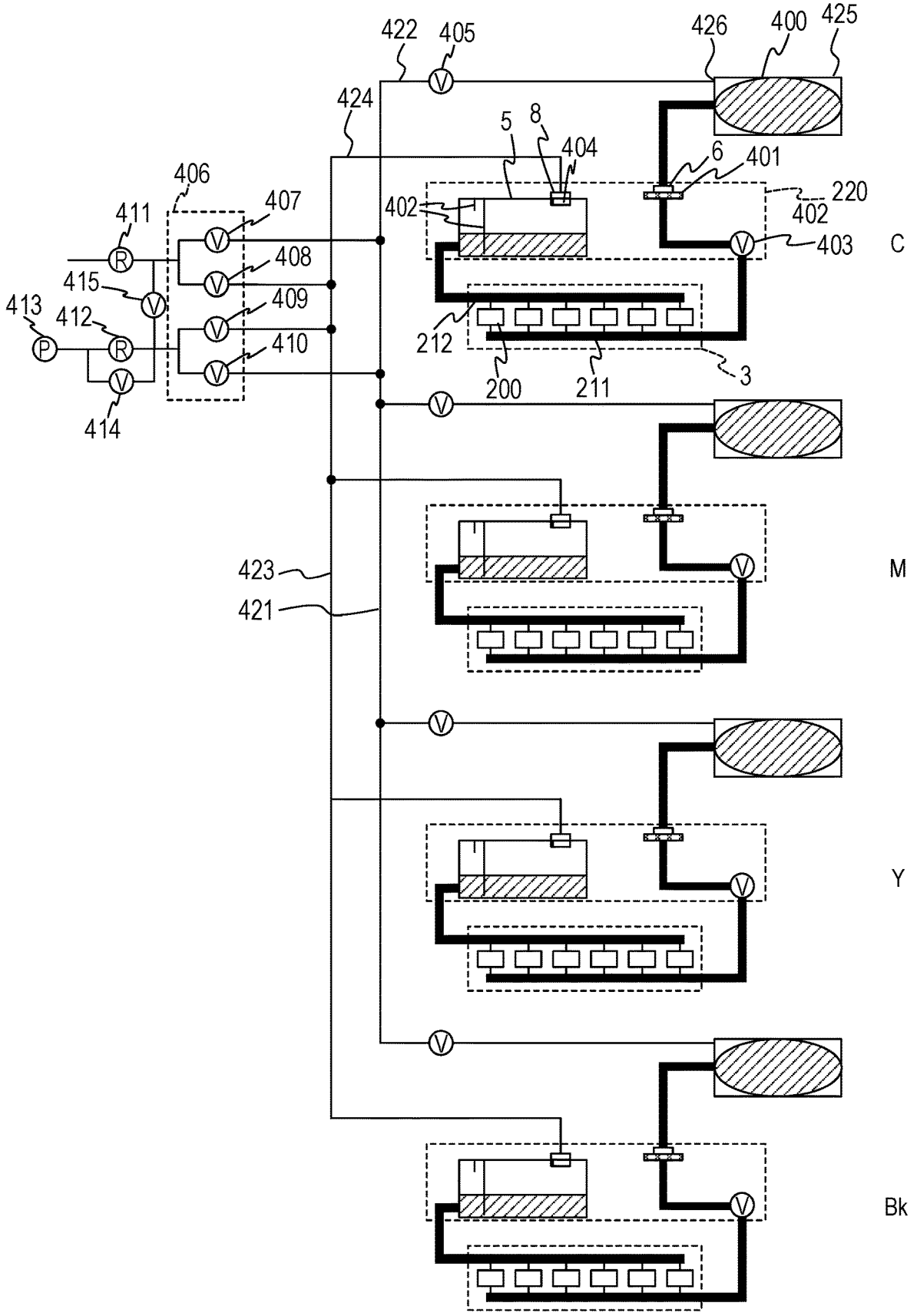
FIG. 8 is a schematic configuration view of a liquid ejection head and a liquid tank according to a third embodiment.

A third embodiment of the present disclosure will be described. Descriptions of the same configurations as those of the first embodiment is omitted, and differences from the first embodiment are mainly described. FIG. 8 is a schematic diagram illustrating schematic configurations of the liquid ejection unit 200 and the pressure control mechanism 420 in the present embodiment. In the present embodiment, the main tank 400 also serves as the first liquid tank 4, and the first liquid tank 4 in the first and second embodiments is not provided. Therefore, a cost and size of the recording apparatus 1000 can be reduced. Further, since it is not necessary to replenish the first liquid tank 4 with the ink, a preparation time for recording can be reduced.

The main tank 400 (first liquid tank 4) is a bag made of a flexible material such as vinyl, and the bag is accommodated in a tank housing 425. The main tank 400 has a remaining amount detection mechanism (not illustrated) inside the main tank 400, and the tank housing 425 has a communication port 426 connected to the first individual line 422. Therefore, ae pressure applied to the main tank 400 is applied from outside the main tank 400. The pressure is applied to the main tank 400 from the pressure control mechanism 420, and thus, as in the first embodiment, the ink can circulate in both directions. As in the first embodiment, the method for filling the second liquid tank 5 with the ink can be performed by attaching the cap member 9, and thereafter, suctioning the second liquid tank 5 at a high negative pressure.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2019-048489, filed Mar. 15, 2019, which is hereby incorporated by reference herein in its entirety.

What is claimed is:

1. A liquid ejection apparatus comprising:

a plurality of liquid ejection units each including an ejection orifice which ejects a liquid, first and second liquid tanks which store the liquid, and a liquid flow path which connects the first liquid tank and the second liquid tank to each other across the ejection orifice, and ejecting different types of liquids;

a cap member which covers of the ejection orifices of the plurality of liquid ejection units and forms a space sealed between the ejection orifices of the plurality of liquid ejection units and the cap member; and a pressure control mechanism which simultaneously pressurizes the first and second liquid tanks.

2. The liquid ejection apparatus according to claim 1, further comprising:

a flow path switching unit which switches the liquid flow path to a first state where the first liquid tank is isolated from the ejection orifice and the second liquid tank and a second state where the first liquid tank and the second liquid tank communicate with each other across the ejection orifice; and a controller which controls the flow path switching unit and the pressure control mechanism, wherein the controller performs an isolation step of controlling the flow path switching unit so that the liquid flow path is switched to the first state, a negative pressure forming step of controlling the pressure control mechanism so that a negative pressure lower than a pressure applied to the first liquid tank is applied to the second liquid tank in the first state, a liquid filling step of switching the liquid flow path to the second state and controlling the flow path switching unit so that the second liquid tank is filled with the liquid in the first liquid tank, and a pressurization step of controlling the pressure control mechanism so that the first and second liquid tanks are simultaneously pressurized, in this order.

3. The liquid ejection apparatus according to claim 2, further comprising:

a main tank which communicates with the first liquid tank, wherein the pressure control mechanism applies a negative pressure to the first liquid tank and fills the first liquid tank with the liquid in the main tank, between the isolation step and the negative pressure forming step.

4. The liquid ejection apparatus according to claim 3, wherein the pressure control mechanism is provided in common for a plurality of types of the liquids, the liquid ejection apparatus further comprising:

a common line which is connected to the pressure control mechanism;

an individual line which branches off from the common line, is connected to each first liquid tank, and applies the negative pressure to the first liquid tank;

an individual valve which is provided in each individual line; and a liquid level gauge which is provided in each first liquid tank, wherein the controller closes a corresponding individual valve when a liquid level measured by the liquid level gauge reaches a predetermined value.

5. The liquid ejection apparatus according to claim 2, wherein the first liquid tank has flexibility and the pressure applied to the first liquid tank is applied from outside the first liquid tank.

6. The liquid ejection apparatus according to claim 2, wherein one end of the liquid flow path is connected to the first liquid tank and the other end of the liquid flow path is connected to the second liquid tank, and wherein the flow path switching unit includes a first valve provided between the first liquid tank and the ejection orifice and closes the first valve to switch the liquid flow path to the first state.

7. The liquid ejection apparatus according to claim 2, wherein the liquid flow path is a circulation flow path which connects the ejection orifice, the first liquid tank, and the second liquid tank to each other, and wherein the flow path switching unit includes a first valve provided between the first liquid tank and the ejection orifice and a second valve provided between the first liquid tank and the second liquid tank, and closes the first and second valves to switch the liquid flow path to the first state.

8. The liquid ejection apparatus according to claim 7, wherein the flow path switching unit temporarily opens the first valve during the negative pressure forming step and fills a section of the liquid flow path from the first liquid tank to the ejection orifice with the liquid.

9. The liquid ejection apparatus according to claim 2, further comprising:

a driving mechanism which drives the cap member, wherein the controller controls the driving mechanism so that the cap member is attached to the ejection orifice, before the negative pressure forming step.

10. The liquid ejection apparatus according to claim 2, wherein the pressure control mechanism includes a first pressure generating unit which generates a first pressure, a second pressure generating unit which generates a negative pressure lower than the first pressure, and a switching mechanism between the first pressure generating unit and the second pressure generating unit.

11. The liquid ejection apparatus according to claim 10, wherein the switching mechanism has a differential valve located between the first pressure generating unit and the second pressure generating unit.

12. The liquid ejection apparatus according to claim 10, wherein the first pressure generating unit is a pressure reducing valve of which one end side is open to an atmosphere and the other end side is open when a pressure is below a predetermined set pressure.

13. The liquid ejection apparatus according to claim 10, wherein the second pressure generating unit includes a vacuum pump, a negative pressure adjustment mechanism which is connected to the vacuum pump on an upstream side of the vacuum pump, and a bypass valve which bypasses the negative pressure adjustment mechanism, and the controller controls the pressure control mechanism so that the vacuum pump is operated in a state where the bypass valve is open and the negative pressure is generated.

14. The liquid ejection apparatus according to claim 10, wherein the controller controls the pressure control mechanism so that the first pressure is applied to the first liquid tank and the second liquid tank in the pressurization step.

15. The liquid ejection apparatus according to claim 2, wherein the pressure control mechanism includes a first pressure generating unit which generates a first pressure and a second pressure generating unit which generates a negative pressure lower than the first pressure, and the second pressure generating unit is a vacuum pump which is connected to the cap member.

16. The liquid ejection apparatus according to claim 15, wherein the vacuum pump performs preliminary ejection of the ejection orifice after the pressurization step.

17. The liquid ejection apparatus according to claim 1, wherein the cap member is a check valve which is closed when a pressure in the space is a predetermined value or less and is opened when the pressure exceeds a predetermined value.

18. A liquid filling method in a liquid ejection apparatus which includes a plurality of liquid ejection units each including an ejection orifice which ejects a liquid, first and second liquid tanks which store the liquid, and a liquid flow path which connects the first liquid tank and the second liquid tank across the ejection orifice, and ejecting different types of liquids, the method comprising:

an isolation step of switching the liquid flow path to a first state where the first liquid tank is isolated from the ejection orifice and the second liquid tank, by a flow path switching unit;

a capping step of covering the ejection orifices of the plurality of liquid ejection units with a cap member to form a space sealed between the ejection orifices of the plurality of liquid ejection units and the cap member;

a negative pressure forming step of applying a negative pressure lower than a pressure applied to the first liquid tank to the second liquid tank by a pressure control mechanism, after the isolation step and the capping step;

a liquid filling step of switching the liquid flow path to a second state where the first liquid tank and the second liquid tank communicate with each other across the ejection orifice by the flow path switching unit and filling the second liquid tank with the liquid in the first liquid tank, after the negative pressure forming step; and a pressurization step of simultaneously pressurizing the first and second liquid tanks by the pressure control mechanism to discharge a portion of the liquid in the liquid flow path from the ejection orifice, after the liquid filling step.

* * * * *